US009926781B2

(12) United States Patent
Xia et al.

(10) Patent No.: US 9,926,781 B2
(45) Date of Patent: Mar. 27, 2018

(54) WIDE BANDWIDTH DRILL PIPE STRUCTURE FOR ACOUSTIC TELEMETRY

(71) Applicant: Halliburton Energy Services, Inc., Houston, TX (US)

(72) Inventors: Hua Xia, Huffman, TX (US); Chris Gao, Kingwood, TX (US); Chung Chang, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 83 days.

(21) Appl. No.: 15/034,693

(22) PCT Filed: Dec. 31, 2014

(86) PCT No.: PCT/US2014/072975

§ 371 (c)(1),
(2) Date: May 5, 2016

(87) PCT Pub. No.: WO2016/108881

PCT Pub. Date: Jul. 7, 2016

(65) Prior Publication Data

US 2016/0341032 A1 Nov. 24, 2016

(51) Int. Cl.

| | |
|---|---|
| ***E21B 17/16*** | (2006.01) |
| ***E21B 47/14*** | (2006.01) |
| ***E21B 47/16*** | (2006.01) |
| ***E21B 17/042*** | (2006.01) |

(52) U.S. Cl.
CPC ..... *E21B 47/16* (2013.01); *E21B 17/042* (2013.01); *E21B 47/14* (2013.01)

(58) Field of Classification Search
CPC ..... E21B 17/003; E21B 17/16; E21B 47/14; E21B 47/16
See application file for complete search history.

(56) References Cited

U.S. PATENT DOCUMENTS 5,477,505 A * 12/1995 Drumheller ..... E21B 47/16 166/250.01
6,108,268 A * 8/2000 Moss ..... E21B 17/00 175/56
6,791,470 B1 9/2004 Drumheller
(Continued)

OTHER PUBLICATIONS

"International Application Serial No. PCT/US2014/072975, International Search Report dated Sep. 21, 2015", 3 pgs, dated Sep. 21, 2017.

(Continued)

*Primary Examiner* — Cathleen R Hutchins
(74) *Attorney, Agent, or Firm* — Haynes & Boone, LLP

(57) ABSTRACT

In some examples, a drillstring includes a plurality of drill pipe sections that are coupled together by a drill pipe joint section structure. The drill pipe sections and the drill pipe joint section structure are acoustically impedance matched. In another example, the drill pipe sections comprise a plurality of different pipe lengths, those lengths being different than a length of the drill pipe joint section structure. A drillstring is constructed of these different lengths of drill pipe and drill pipe joint section structures in a non-periodic manner or random sequence. In another example, the drill pipe sections and drill pipe joint section structure comprise materials having substantially similar acoustic properties.

21 Claims, 6 Drawing Sheets

(56) References Cited

U.S. PATENT DOCUMENTS

| | | | |
|---|---|---|---|
| 2004/0095847 | A1 | 5/2004 | Hassan et al. |
| 2005/0087368 | A1 | 4/2005 | Boyle et al. |
| 2014/0090898 | A1 | 4/2014 | Moriarty et al. |

OTHER PUBLICATIONS

"International Application Serial No. PCT/US2014/072975, Written Opinion dated Sep. 21, 2015", 10 pgs.

* cited by examiner

WIDE BANDWIDTH DRILL PIPE STRUCTURE FOR ACOUSTIC TELEMETRY

PRIORITY APPLICATIONS

This application is a U.S. National Stage Filing under 35 U.S.C. 371 from International Application No. PCT/US2014/072975, filed on Dec. 31, 2014, which application is incorporated herein by reference in its entirety.

BACKGROUND

During drilling operations for extraction of hydrocarbons, a variety of communication and transmission techniques have been attempted to provide real time data from the vicinity of the bit to the surface during drilling. The use of measurement-while-drilling (MWD) and logging-while-drilling (LWD), with real time data transmission, provides substantial benefits during a drilling operation. For example, monitoring of downhole conditions (e.g., temperature, pressure, resistivity, density, and electromagnetic fields) allows for an immediate response to potential well control problems and improves mud programs.

Mud-pulse and electromagnetic telemetries are most commonly used for transmitting downhole data to the surface with a typical 3-10 bits/sec data rate. Acoustic telemetry may provide higher transmission capabilities at 40-80 bits/sec data rates with drill pipe as a transmission line.

While acoustic telemetry may provide fast data rate benefits not possible in mud-pulse and electromagnetic telemetrics, the existing acoustic telemetry technique suffers from signal reflection or transmission loss at each acoustic impedance mismatched interface because existing drillpipe structures lead to formation of frequency stopbands and passbands. In particular, when transmitting acoustic signals within one of the frequency passbands, high data error and low signal-to-noise ratio may result in the loss of the acoustic signals or in the limited transmission range. The frequency stopbands and passbands may drift by thermal induced variations of the pipe length and surrounding acoustic impedance variation, such as the varied mud density. This may limit available acoustic transmission channels and induce signal transmission reliability issues.

DETAILED DESCRIPTION

To address some of the challenges described above, as well as others, apparatus, systems, and methods for acoustic impedance matching drill pipe are described. The described examples may reduce or eliminate acoustic impedance induced reflection at pipe joint sections and reduce or eliminate acoustic frequency stopbands. Drill pipe acoustic signals may be transmitted from the downhole environment to a different depth (e.g., geological formation surface) through a transmission medium (e.g., drillstring) having only one passband without conventional stopbands. Thus, transmission of downhole acoustic signals may then have more reliable acoustic data transmissions within a wide frequency band without suffering from stopbands or passband variations.

Figure 1:
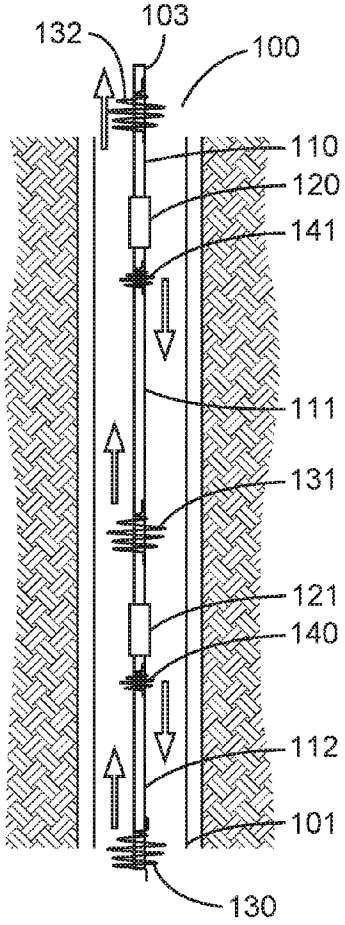
FIG. 1 is a diagram showing acoustic transmission and reflection on a drill pipe in a downhole environment.

FIG. 1 is a diagram showing acoustic transmission and reflection on a drill pipe in a downhole environment. The propagating acoustic wave could be produced by electromagnetic device with a modulated frequency. An acoustic wave may be longitudinal compressive wave, shear wave, even Stoneley surface waves. A wellbore 100 is shown having a casing or liner 101 that lines the wellbore. A drillstring 103 has been inserted into the wellbore. The drillstring 103 includes a plurality of sections 110-112 of drill pipe that are joined at drill pipe joint section structures 120, 121.

Acoustic telemetry utilizes acoustic waves to transmit sensing data (e.g., temperature, pressure, electromagnetic field, resistivity) from LWD/MWD tools (not shown), through the drillstring 103. A forward acoustic signal 130-132 may be transmitted from the downhole environment such that it propagates through the drillstring 103. If the drill pipe joint section structures 120, 121 have impedances differences, a portion of the transmitted acoustic wave 132 may be successfully transmitted through the drillstring 103 but would be lost or attenuated from the original transmission due to acoustic wave reflections 140, 141.

The acoustic wave reflections 140, 141 are a result of the drill pipe joint section structures 120, 121 having a different impedance of joint section ($Z_2$) than the impedance of the pipe section ($Z_1$). Both $Z_1$ and $Z_2$ may be defined by a product of phase velocity ($\upsilon$) and mass density ($\rho$) of the pipe sections 110-112 or drill pipe joint section structures 120, 121. This may be represented by $Z=\upsilon\cdot\rho$.

Figure 2:
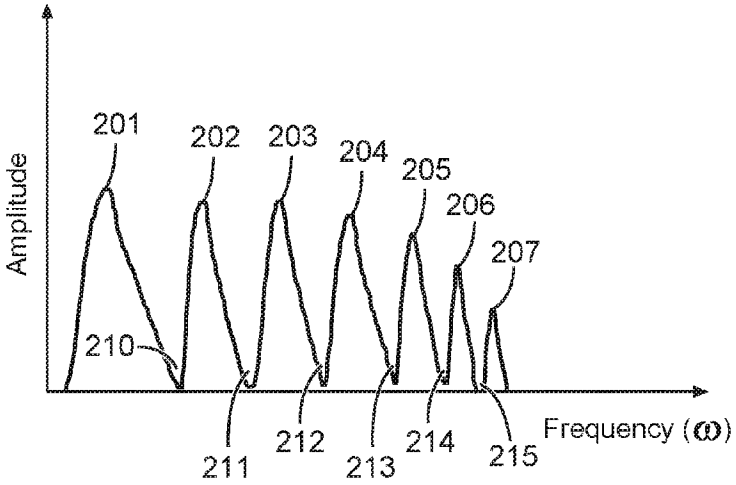
FIG. 2 is a plot showing frequency versus amplitude of acoustic transmissions with passbands and stopbands.

When the drillstring 103 has a periodic $Z_1$-$Z_2$ modulated string, the reflected acoustic waves 140, 141 may be in-phase and constructive. The acoustic band structure is dependent upon the total length of the drilling pipe and joint section, which may result in multiple frequency passbands separated by frequency regions referred to as stopbands. FIG. 2 is a plot showing frequency ($\omega$)) versus amplitude of acoustic transmissions with passbands 201-207 and stopbands 210-215 resulting from the reflected acoustic waves. The acoustic signal will be strongly attenuated at stopband points, 210, 211, 212, 213, 214, 215, while acoustic signals can be transmitted at 201, 202, 203, 204, etc., namely, acoustic passband.

An acoustic signal transmission from the downhole environment has a specific frequency passband for the transmission channel. Signal loss may occur if the specific passband has drifted either by mechanical or by thermal strain. The acoustic signal transmission may be attenuated below a usable threshold if the passband has drifted from a tolerated range, $\Delta\omega$, of the specific frequency passband. For example, the downhole geologic thermal gradient is about 25° C./km, the thermal expansion of the drilling pipes will expand its length at different well depth, and make stopband and passband drifting to low-frequency side. This drifting effect may be significant whenever the downhole temperature is more than 120° C. or 4,000 meters depth.

Reducing or eliminating acoustic impedance-induced reflection at each drill pipe joint and/or eliminating frequency stopbands may be accomplished by a number of methods. These methods may be used separately or together in any combination. For example, a method for reducing or eliminating acoustic impedance induced reflections at each pipe joint connection uses acoustic impedance matched drill pipe joint section structures 120, 121 across a selected band of frequencies. A method for reducing or eliminating acoustic frequency stopbands may use non-periodic drillstring pipe sections 110-112 or an anti-phase structure design. A method to further reduce or eliminate acoustic impedance interfaces along the drillstring 103 may include material property matching of the pipe sections 110-112 and the joint section structure 120, 121. Such methods are discussed subsequently in greater detail.

Figure 3:
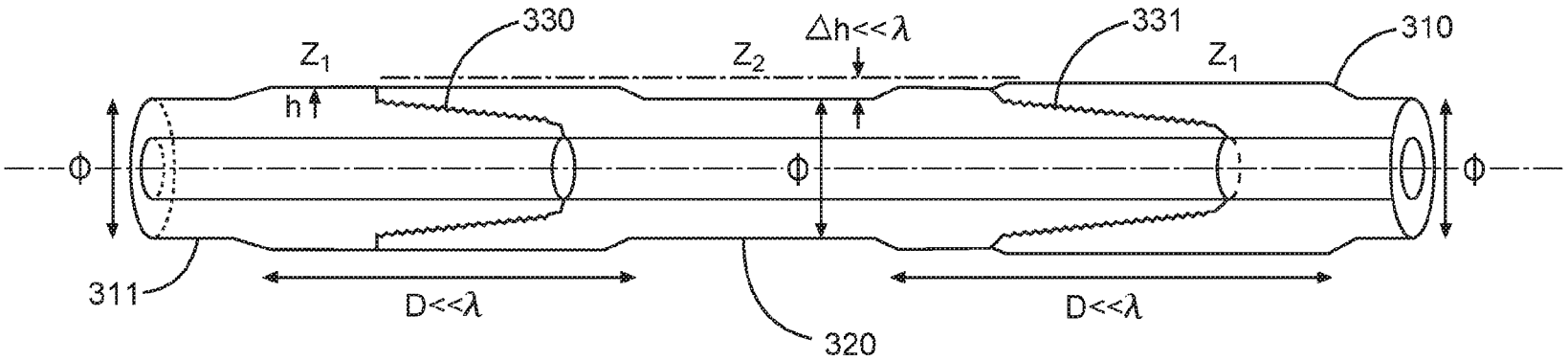
FIG. 3 is a diagram showing an example of acoustic impedance matched drill pipe sections and a drill pipe joint section structure.

FIG. 3 is a diagram showing an example of acoustic impedance matched drill pipe sections and a drill pipe joint section structure. In the following discussions, the impedance of each of the drill pipe sections 310, 311 is represented by $Z_1$. The impedance of the drill pipe joint section structure 320 is represented by $Z_2$. An outside diameter of narrower portions of the drill pipe sections 310, 311 as well as the drill pipe joint section structure 320 is represented by $\varphi$. A wall thickness of the pipe sections 310, 311 and the drill pipe joint section structure 320 is represented by h. A connection section length is represented by D. The wavelength of acoustic signals to be transmitted over the drillstring is represented by $\lambda$.

A drillstring may be constructed by a plurality of acoustic impedance matched drill pipe joint section structures 320, across a selected band of frequencies, coupling drill pipe sections 310, 311, as shown in FIG. 3. The joint section structure and pipe material's related acoustic impedance related reflection amplitude $(Z_2-Z_1)/(Z_1+Z_2)$ is close to the diameter difference $(\varphi_2-\varphi_1)/(\varphi_1+\varphi_2)$ related reflection amplitude while propagating in anti-phase.

The method for reducing or eliminating acoustic impedance induced reflections at each pipe joint connection employs an acoustic impedance matched drill pipe joint section structure 320 having an acoustic impedance that is matched to the adjacent, coupled drill pipe sections 310, 311. The structure 320 is connected between the first and second drill pipe sections 310, 311 by threaded connections 330, 331. The threaded connections may be an internal threaded connection 330 on one side of the structure 320 and an external threaded connection 331 on the other side of the structure 320. In another example, both sides 330, 331 may be externally or internally threaded.

Acoustic wave reflections from the pipe joint section structure may result from multiple mechanisms. For example, one mechanism may be the acoustic impedance difference between the drill pipe sections 310, 311 and the drill pipe joint section structure 320 (i.e., $Z_1 \neq Z_2$). Another mechanism may be the diameter difference between the drill pipe sections 310, 311 and the drill pipe joint section structure 320 (i.e., $\varphi_1 \neq \varphi_2$). In both mechanisms, a partial acoustic wave is reflected with a reflection coefficient, R(z), calculated by:

$$R(z)=(Z_2-Z_1)/(Z_1+Z_2)e^{-i(k\omega+\Phi)}{}_z, \quad [1]$$

$$R(\varphi)=(\varphi_2-\varphi_1)/(\varphi_1+\varphi_2)e^{-i(k\omega+\Phi)}{}_\Phi, \quad [2]$$

where both reflected acoustic waves may have different phases for downward propagations. The reflected signal amplitude is enhanced under an in-phase condition but strongly suppressed by an anti-phase condition. In a very simple case, the phase change occurs at a specific acoustic impedance ratio as indicated by $Z_1>Z_2$ and $\varphi_1>\varphi_2$. To reduce the reflection coefficients, as shown in Eqs. (1-2), the acoustic impedances and the diameter difference are:

$$Z_1-Z_2\approx 0, \quad [3]$$

$$\Delta h=\varphi_1-\varphi_2\approx 0, \quad [4]$$

FIG. 3 illustrates a drill pipe joint section structure that approximately satisfies these conditions. To keep the mechanical structure as a smooth assembly, the wall thickness h of the drill pipe joint section structure has a limited deviation $\Delta h$ from the pipe section out diameter $\varphi$, where the middle section of the structure 320 is tapered smoothly. A way to avoid potential reflection is to set the deviation $\Delta h$ of the wall thickness, as compared to the drill pipe sections, to be much less than the acoustic wavelength, namely, $\Delta h \ll \lambda$. The connection section length is also set to be much less than acoustic wavelength, namely, $D \ll \lambda$.

Figure 4:
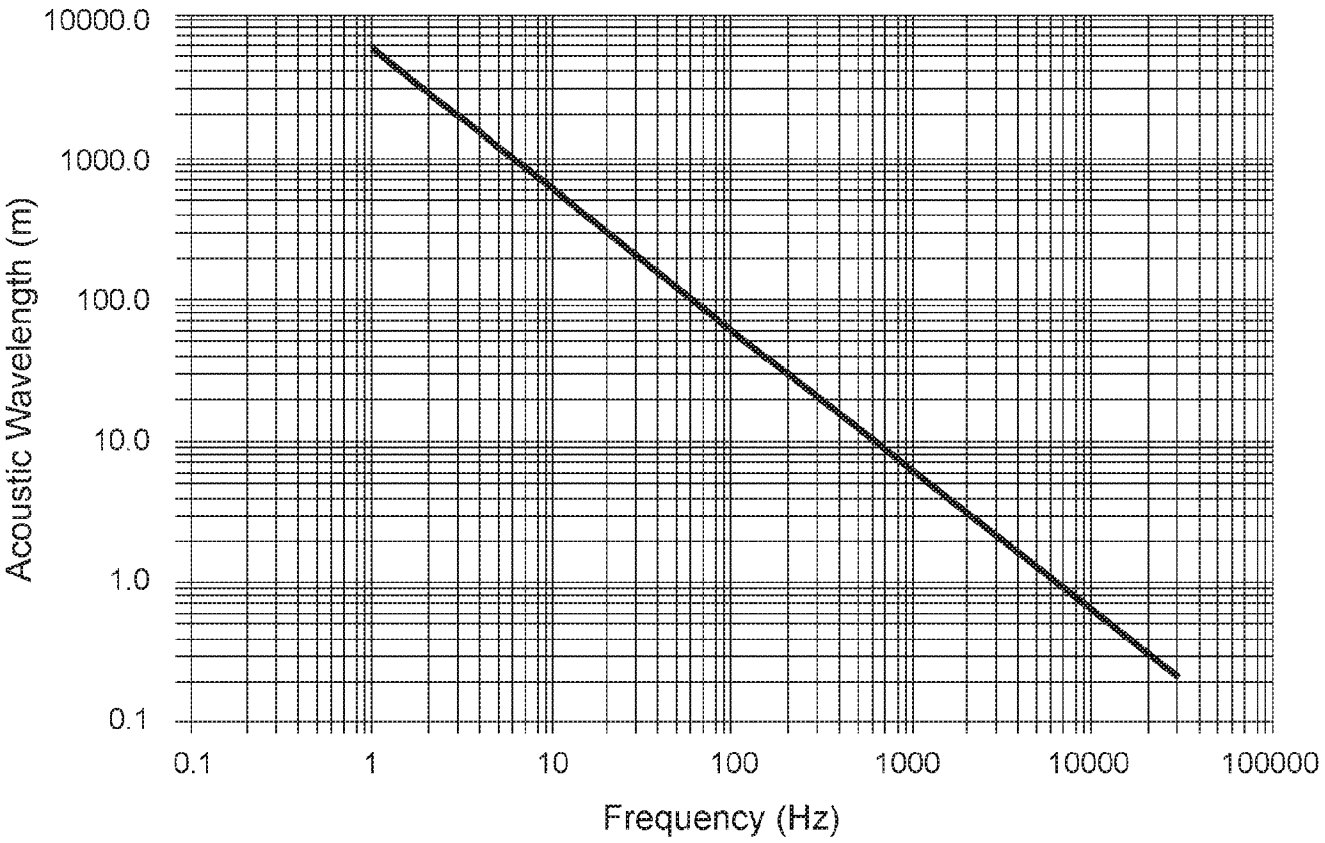
FIG. 4 is a plot showing an example of acoustic wavelength versus frequency in accordance with the example of FIG. 3.

For conventional carbon steel or stainless steel, the phase velocity is about 6000 meters/second and the corresponding acoustic wavelength is a function of the excitation frequency. FIG. 4 is a plot showing acoustic wavelength (in meters) versus frequency Hertz) in accordance with the example of FIG. 3. This figure shows that the acoustic wavelength is greater than 1 meter (m) for a frequency of less than 6 kHz. Selection for $\Delta h \ll \lambda$ and $D \ll \lambda$ may be $\Delta h/\lambda < 0.1\%$ and $D/\lambda$ less than 1%, respectively. The wavelength of a high-frequency acoustic wave may be approximately 0.2 m at 30 kHz as an upper limit for the drill pipe joint section structure 320 to be an effective non-acoustic impedance structure.

The method to reduce or eliminate acoustic frequency stopbands may be accomplished using an anti-phase structure for the drillstring or non-periodic drillstring pipe sections in the drillstring. Both examples are described subsequently.

Passband and stopband drift-induced transmission instability may be reduced or eliminated by suppressing reflected acoustic waves by two reflection waves (i.e., R(z), R($\varphi$)) having anti-phase condition and being equal in amplitude. This may be represented by:

$$R(Z)=-R(\varphi), \text{ and } \varphi_z-\varphi_\varphi=(2n-1)\pi, n=0,1,2,3,\ldots \quad [6]$$

Figure 5:
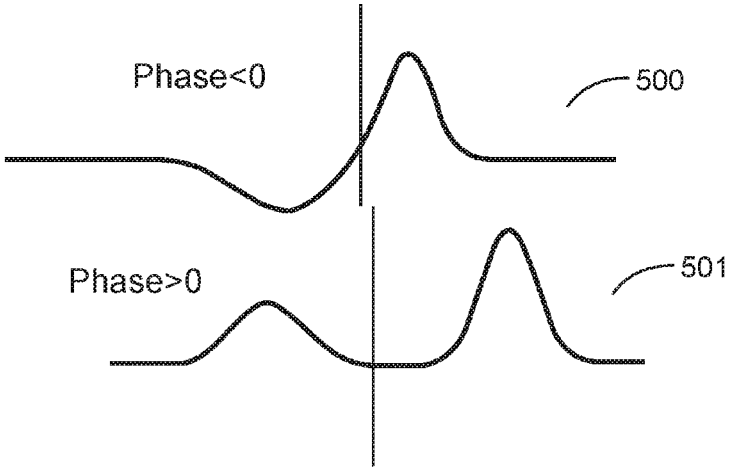
FIG. 5 is a plot showing an example of anti-phase acoustic waves that reduce or eliminate reflected acoustic waves.

FIG. 5 is a plot showing anti-phase acoustic waves that reduce or eliminate reflected acoustic waves. The acoustic waves 500, 501 reflected from a pipe joint section structure have different phases. For example, the top wave has a phase <0 while the bottom wave has a phase >0. The anti-phase condition may be represented by:

$$\left[\frac{(Z_2-Z_1)}{(Z_1+Z_2)}\right] \approx -\frac{(\phi_2-\phi_1)}{(\phi_1+\phi_2)} \quad [7]$$

When the acoustic impedance and diameter related reflected wave amplitudes are nearly equal but in a phase difference of $(2n-1)\pi$, the reflected waves from the drill pipe joint section structure experience a destructive interference as represented by:

$$\omega_1=\omega_2, A_1\approx A_2, \Delta\Psi_{12}\approx\pi \quad [8]$$

Such an anti-phase joint section structure may reduce or eliminate the reflected acoustic waves. Thus, anti-phase pipe joint section structure design has an intrinsic nature for eliminating acoustic wave downward propagation and maximizing acoustic signal transmission.

When there is no reflected acoustic waves from each pipe joint section structure due to acoustic impedance matching, the drillstring is not able to form stopbands and passbands. While this may be good enough for low-loss acoustic wave transmissions from downhole bottom to the surface, the acoustic impedance matching and anti-phase designs may be valid only in a certain range of downhole temperatures. The varying temperature along the wellbore may not satisfy such impedance matching conditions because thermal expansion differences in drill pipe sections and drill pipe joint section structure materials. Whenever such an ideal match is lost, weakly reflective acoustic waves from different pipe joint sections still may form the passband and stopband frequencies. Building the drillstring in a non-periodic sequence, as described subsequently, may reduce or eliminate the multiple passbands and stopbands.

Figure 6:
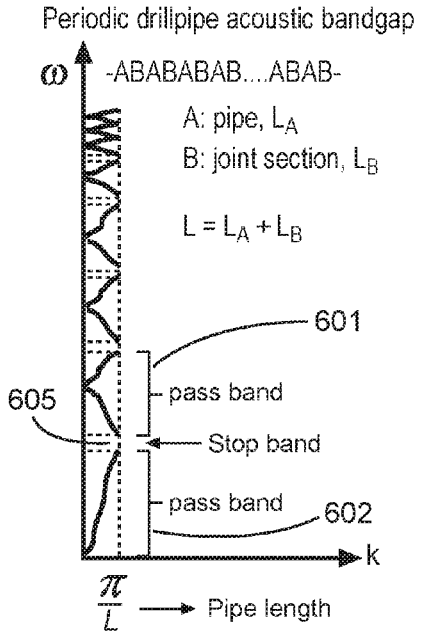
FIG. 6 is a plot showing an acoustic frequency versus wave vector of a typical periodic drillstring acoustic band-gap.

Typical drillstrings are made up of a plurality of drill pipe sections (A) having a length represented by $L_A$ and drill pipe joint section structures (B) having a length represented by $L_B$. A typical drill string having a periodic structure and, thus, experiencing acoustic frequency stopbands, may be represented by -ABABARAB . . . AB-. FIG. 6 illustrates the acoustic band-gap results of a periodic drillstring.

FIG. 6 is a plot showing an acoustic frequency ($\omega$) versus wave vector (k) of typical periodic drillstring acoustic band-gap. If the total length of the pipe section (A) and joint section structure (B) is $L=L_A$ (pipe)$+L_B$ (joint section), the acoustic wave vector is represented by $\pi/L$. The periodic modulated acoustic dispersion curves have frequency-dependent passbands 601, 602 and stopbands 605 as shown. It is clear that no acoustic waves can transmit in a stopband such that an acoustic transmission channel has to be chosen at a specific frequency range and consider the transmission band thermal drift effect. It may be difficult to determine this drift effect at different downhole depths due to the mechanical and thermal strains that may be involved.

In a non-periodic drillstring example, at least three different lengths of pipe sections/joint section structures may be used. For example, pipe A may have a length of $L_A$, pipe B may have a length of $L_B$, and pipe C may have a length of $L_C$, where $L_A\neq L_B\neq L_C$. As an example, such drill pipe lengths may include lengths from 30 ft, 60 ft, and 90 ft from commercial available selections. The drill pipe joint section structure may be one of these pipes (e.g., A, B, C) or some other length. Such a non-periodic example may be constructed into a drillstring as -ABCCBBAA . . . CBA-, wherein the arranged sequence of the drill pipes is a random order arranged without an average modulation length. The illustrated order of pipe sections and drill pipe joint section structures is for purposes of illustration only as any random order may be used. While three different lengths of pipe are discussed, any number of pipe lengths may be used (e.g., $L_A$, $L_B$, $L_C$, $L_D$) that may be represented by $L_k$.

Figure 7:
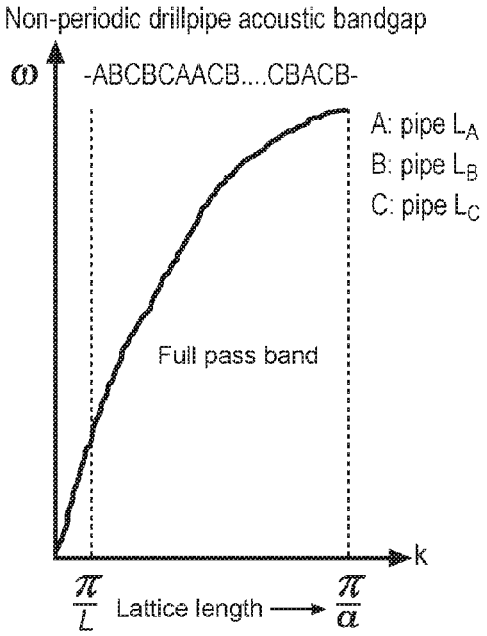
FIG. 7 is a plot showing an acoustic frequency versus wave vector of an example of a non-periodic drillstring acoustic band-gap.

When using a random sequence to building a drillstring, there is no periodic modulation that can be used to predict a specific pipe length at a specific location. As illustrated in FIG. 7, a benefit of this non-periodic modulated pipe building sequence is that the drillstring acts as an acoustic waveguide with a broad passband, where its acoustic frequency is continuous from long-wavelength at $k\approx 0$ to $k=\pi/a$, where a is an average lattice constant of the pipe material. In this way, such a drillstring becomes a broadband acoustic channel and enables signal transmission from downhole to the surface without suffering from potential signal loss due to temperature related stopband drift.

The method to further reduce or eliminate acoustic impedance interfaces along the drillstring by material property matching the acoustic properties of the pipe sections and the joint section structure may provide a transmission medium having only one passband without intervening stopbands. This method may be accomplished in multiple ways. In one example, the material used for the drill pipe sections may be chosen to be exactly the same as the material used for the drill pipe joint section structure.

In another example, the density and phase velocity of the material for the drill pipe joint section structure may be reduced to effectively compensate for the diameter difference ($\varphi_2-\varphi_1>0$) between the two pipe sections. In this example, the product of the phase velocity ($\upsilon_1$) and density ($\rho_1$) of the drill pipe section material is made equal to the produce of the phase velocity ($\upsilon_2$) and density ($\rho_2$) of the drill pipe joint section structure material are approximately equal as represented by:

$$\upsilon_1\cdot\rho_1\approx\upsilon_2\cdot\rho_2 \quad [5]$$

Figure 8:
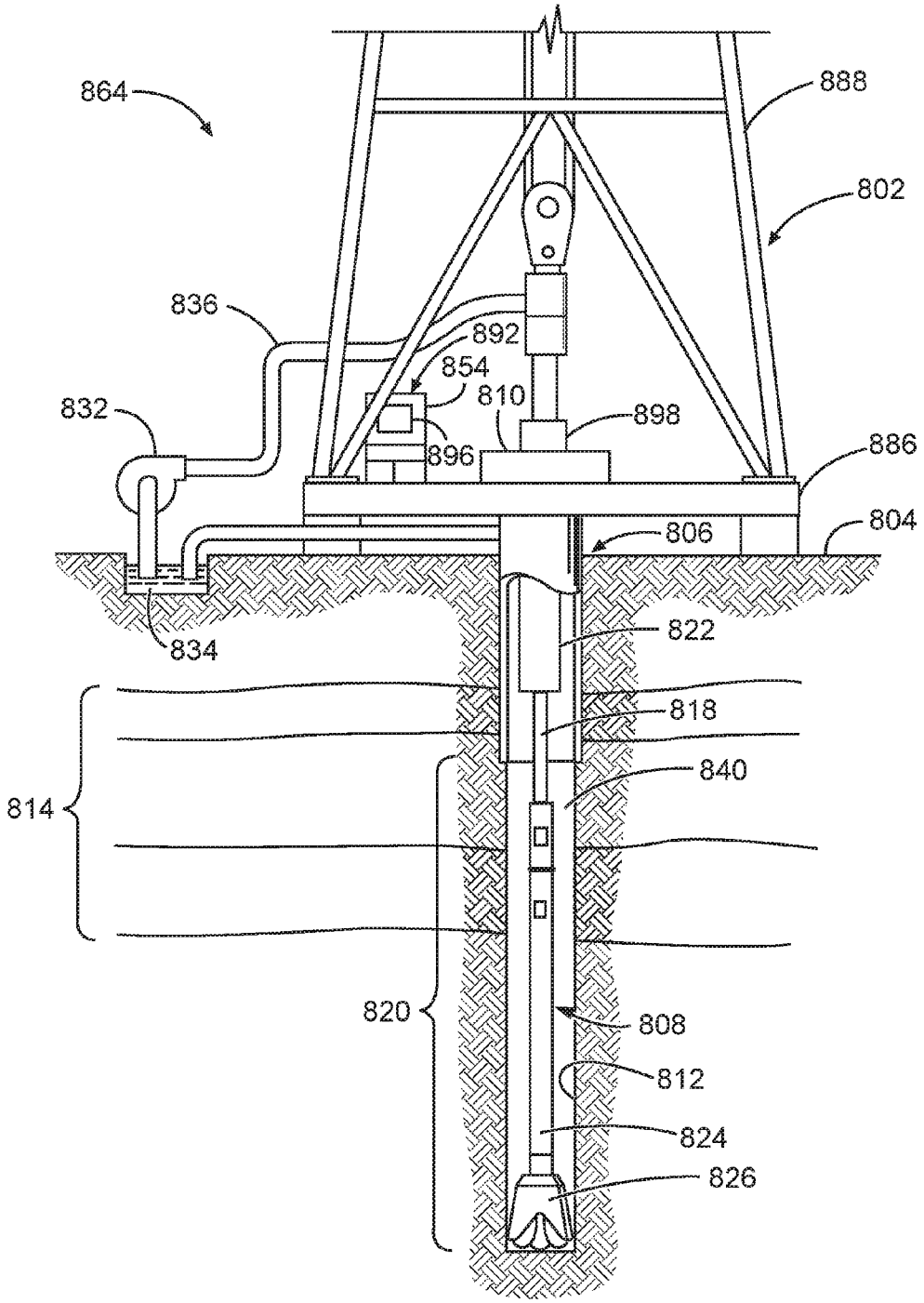
FIG. 8 is a diagram showing an example of drilling rig system in accordance with various examples.

FIG. 8 is a diagram showing an example of a drilling rig system in accordance with various examples. Thus, the system 864 may include portions of a downhole tool 824, as part of a downhole drilling operation.

The system 864 may form a portion of a drilling rig 802 located at the surface 804 of a well 806. The drilling rig 802 may provide support for the drillstring 808. The drill string 808 may operate to penetrate a rotary table 810 for drilling a borehole 812 through subsurface geological formations 814. The drillstring 808 may include a plurality of drill pipe sections 818 connected by drill pipe joint section structures 819, as discussed previously. A bottom hole assembly 820 may be located at the lower portion of the drillstring 808.

The bottom hole assembly 820 may include drill collars 822, a downhole tool 824, and a drill bit 826. The drill bit 826 may operate to create a borehole 812 by penetrating the surface 804 and subsurface formations 814. The downhole tool 824 may comprise any of a number of different types of tools including measuring while drilling (MWD) tools, logging while drilling (LWD) tools, and others.

During drilling operations, the drillstring 808 may be rotated by the rotary table 810. In addition to, or alternatively, the bottom hole assembly 820 may also be rotated by a motor (e.g., a mud motor) that is located downhole. The drill collars 822 may be used to add weight to the drill bit 826. The drill collars 822 also operate to stiffen the bottom hole assembly 820, allowing the bottom hole assembly 820 to transfer the added weight to the drill bit 826, and in turn, to assist the drill bit 826 in penetrating the surface 804 and subsurface formations 814.

During drilling operations, a mud pump 832 may pump drilling fluid (sometimes known by those of ordinary skill in the art as "drilling mud") from a mud pit 834 through a hose 836 into the drill pipe 818 and down to the drill bit 826. The drilling fluid can flow out from the drill bit 826 and be returned to the surface 804 through an annular area 840 between the drill pipe 818 and the sides of the borehole 812. The drilling fluid may then be returned to the mud pit 834, where such fluid is filtered. In some examples, the drilling fluid can be used to cool the drill bit 826, as well as to provide lubrication for the drill bit 826 during drilling operations. Additionally, the drilling fluid may be used to remove subsurface formation 814 cuttings created by operating the drill bit 826.

In some examples, a system 864 can include a display 896, computation logic, perhaps as part of a surface logging facility 892, or a computer workstation 854, to receive signals from transducers, receivers, and other instrumentation to determine properties of the formation 814 and to transform acoustic data that has been received through acoustic telemetry through the drillstring 808 as discussed previously. Data may be transmitted from the downhole tool 824 through an acoustic telemetry method during LWD/MWD operations.

The processor/controllers/memory discussed herein can be characterized as "modules". Such modules may include hardware circuitry, and/or a processor and/or memory circuits, software program modules and objects, and/or firmware, and combinations thereof, as appropriate for particular implementations of various examples.

Figure 9:
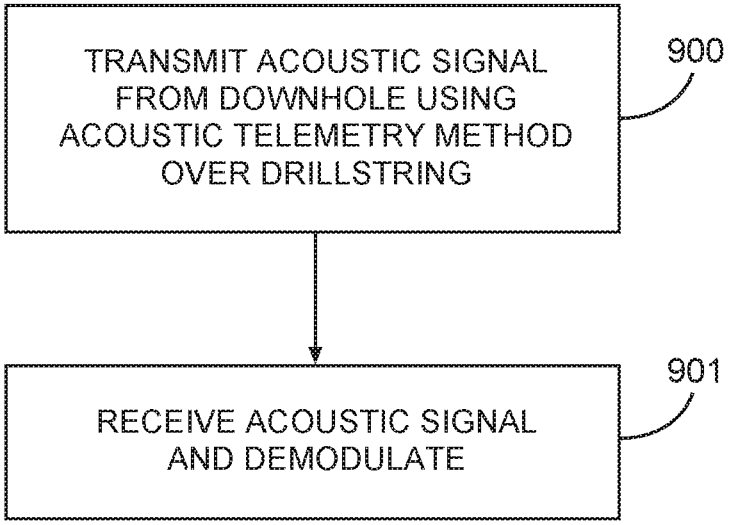
FIG. 9 is a flowchart showing an example of a method for acoustic signal transmission.

FIG. 9 is a flowchart showing an example of a method for acoustic signal transmission. The method uses a drillstring as a low-loss acoustic transmission line for acoustic signal telemetry.

In block 900, an acoustic signal is transmitted over the drillstring from the downhole environment (e.g., downhole tool) to a different level (e.g., surface). This transmission is performed over the drillstring that has been constructed to reduce or eliminate acoustic impedance reflections and acoustic frequency stopbands. One or more of the above methods of construction of the drillstring may be used. In block 901, the acoustic signal is received at the different level and demodulated.

The acoustic impedance matching and non-periodic drillstring examples may improve acoustic telemetry downhole transmissions. One or more of the examples may be used in applications such as improving seismic while drilling, short hop, and LWD/MWD.

Example 1 is a drillstring comprising: a plurality of drill pipe sections; and at least one drill pipe joint section structure configured to couple adjacent drill pipe sections of the plurality of drill pipe sections, wherein the drill pipe sections and the drill pipe joint section structure are acoustically impedance matched across a selected band of frequencies.

In Example 2, the subject matter of Example 1 can further include wherein the plurality of drill pipe sections each include a length of one of $L_A$ or $L_B$ and the drill pipe joint section structure comprises length of $L_C$, wherein $L_A \neq L_B \neq L_C$.

In Example 3, the subject matter of Examples 1-2 can further include wherein the drillstring further comprises a plurality of drill pipe joint section structures each configured to couple adjacent drill pipe sections such that the drillstring comprises a non-periodic sequence of drill pipe section lengths and drill pipe joint section structure lengths.

In Example 4, the subject matter of Examples 1-3 can further include wherein the drill pipe joint section structure comprises external threaded connections and/or internal threaded connections for coupling to the adjacent drill pipe sections.

In Example 5, the subject matter of Examples 1-4 can further include wherein the drill pipe sections have an outside diameter represented by $\varphi_1$, a wall thickness represented by h, a connection length represented by D, and an impedance represented by $Z_1$, further wherein the drill pipe joint section structure has an outside diameter represented by $\varphi_2$, a wall thickness deviation, as compared to the drill pipe sections, represented by $\Delta h$, and an impedance represented by $Z_2$, wherein $Z_1 - Z_2 \approx 0$, $\Delta h = \varphi_1 - \varphi_2 \approx 0$.

In Example 6, the subject matter of Examples 1-5 can further include wherein a signal transmitted on the drillstring using an acoustic method has a wavelength of $\lambda$, wherein $\Delta h \ll \lambda$ and $D \ll \lambda$.

In Example 7, the subject matter of Examples 1-6 can further include wherein the plurality of drill pipe sections and the drill pipe joint section structure comprise materials having substantially similar acoustic properties.

In Example 8, the subject matter of Examples 1-7 can further include, wherein the plurality of drill pipe sections and the drill pipe joint section structure comprise the same materials.

In Example 9, the subject matter of Examples 1-8 can further include wherein the drill pipe joint section structure is configured to suppress reflected acoustic wave with an anti-phase design between the acoustic impedance mismatch and pipe/joint section diameter mismatch.

In Example 10, the subject matter of Examples 1-9 can further include wherein the plurality of drill pipe sections have a phase velocity of $\upsilon_1$ and a density of $\rho_1$, the drill pipe joint section structure has a phase velocity of $\upsilon_2$ and a density of $\rho_2$, and $Z_1(\upsilon_1 \cdot \rho_1) \approx Z_2(\upsilon_2 \cdot \rho_2)$.

Example 11 is a method for building a drillstring, the method comprising: coupling adjacent drill pipe sections together through a drill pipe joint section structure wherein the drill pipe joint section structure and the drill pipe sections are acoustically impedance matched across a selected band of frequencies.

In Example 12, the subject matter of Example 11 can further include coupling different lengths of adjacent drill pipe sections through a drill pipe joint section structure in a non-periodic structure, wherein the drill pipe sections and drill pipe joint sections include lengths of at least $L_A$, $L_B$, or $L_C$, wherein $L_A \neq L_B \neq L_C$.

In Example 13, the subject matter of Examples 11-12 can further include coupling different lengths of adjacent drill pipe sections through a drill pipe joint section structure in a random structure sequence, wherein the drill pipe sections include different lengths of several pipes which have different lengths, wherein $L_A \neq L_B \neq L_C \neq L_D \neq L_k$.

In Example 14, the subject matter of Examples 11-13 can further include wherein coupling the adjacent drill pipe sections together through the drill pipe joint section structure comprises coupling drill pipe sections and drill pipe joint section structures having substantially similar material properties.

In Example 15, the subject matter of Examples 11-14 can further include, wherein coupling the adjacent drill pipe sections together through the drill pipe joint section structure comprises coupling drill pipe sections and drill pipe joint section structures comprising the same material.

Example 16 is a method for acoustic communication over a drillstring, the method comprising: transmitting a signal from a downhole environment over the drillstring using an acoustic telemetry method, wherein the drillstring comprises a plurality of drill pipe sections and at least one drill pipe joint section structure configured to couple adjacent drill pipe sections of the plurality of drill pipe sections, wherein the drill pipe sections and the drill pipe joint section structure are acoustically impedance matched across a selected band of frequencies.

In Example 17, the subject matter of Example 16 can further include: receiving the signal on a surface of a geological formation; and demodulating the signal.

Example 18 is a drilling system comprising: a drilling rig located on a surface of a geological formation; and a drillstring supported by the drilling rig and configured to drill through the geological formation, the drillstring comprising a plurality of drill pipe sections, adjacent drill pipe sections joined by a drill pipe joint section structure, wherein the drill pipe sections and the drill pipe joint section structures are acoustically impedance matched across a selected band of frequencies.

In Example 19, the subject matter of Example 18 can further include wherein the plurality of drill pipe sections comprise a plurality of different lengths and the drillstring further comprises a non-periodic sequence of drill pipe section lengths and drill pipe joint section structure lengths.

In Example 20, the subject matter of Examples 18-19 can further include wherein the plurality of drill pipe sections and the drill pipe joint section structure comprise the same materials.

In Example 21, the subject matter of Examples 18-20 can further include, wherein the drill string further comprises a downhole tool configured to transmit acoustic telemetry over the drillstring during LWD/MWD operations.

In the foregoing Detailed Description, it can be seen that various features are grouped together in a single example for the purpose of streamlining the disclosure. This method of disclosure is not to be interpreted as reflecting an intention that the claimed examples require more features than are expressly recited in each claim. Rather, as the following claims reflect, inventive subject matter lies in less than all features of a single disclosed example. Thus the following claims are hereby incorporated into the Detailed Description, with each claim standing on its own as a separate example.

What is claimed is:

1. A drillstring comprising:

a plurality of drill pipe sections; and a plurality of drill pipe joint section structures, with each drill pipe section structure configured to couple adjacent drill pipe sections of the plurality of drill pipe sections, wherein the drill pipe sections and the drill pipe joint section structures are acoustically impedance matched across a selected band of frequencies, and the drill pipe sections and the drill pipe joint section structures are arranged in a non-periodic sequence of lengths in the drillstring.

2. The drillstring of claim 1, wherein the plurality of drill pipe sections each include a pipe section length that is selected from a group consisting of a length $L_A$ and a length $L_B$, wherein one or more of the drill pipe joint section structures comprise a length $L_C$, and wherein the length $L_A \neq$ the length $L_B \neq$ the length $L_C$.

3. The drillstring of claim 2, wherein the drill pipe sections include several pipes which have different lengths.

4. The drillstring of claim 1, wherein each of the drill pipe joint section structures comprise external threaded connections and/or internal threaded connections for coupling to the adjacent drill pipe sections.

5. The drillstring of claim 1, wherein the drill pipe sections have an outside diameter represented by $\varphi_1$, a wall thickness represented by h, a connection length represented by D, and an impedance represented by $Z_1$, wherein at least one of the drill pipe joint section structures has an outside diameter represented by $\varphi_2$, a wall thickness deviation, as compared to the drill pipe sections, represented by $\Delta h$, and an impedance represented by $Z_2$, and wherein $Z_1 - Z_2 \approx 0$, $\Delta h = \varphi_1 - \varphi_2 \approx 0$.

6. The drillstring of claim 5, wherein a signal transmitted on the drillstring using an acoustic method has a wavelength of $\lambda$, wherein $\Delta h \ll \lambda$ and $D \ll \lambda$.

7. The drillstring of claim 1, wherein the plurality of drill pipe sections and the drill pipe joint section structures comprise materials having substantially similar acoustic properties.

8. The drillstring of claim 1, wherein the plurality of drill pipe sections and the drill pipe joint section structures comprise the same material.

9. The drillstring of claim 1, wherein the drill pipe joint section structures are configured to suppress reflected acoustic wave with an anti-phase design between an acoustic impedance mismatch and pipe/joint section diameter mismatch.

10. The drillstring of claim 1, wherein the plurality of drill pipe sections have a phase velocity of $\upsilon_1$, a density of $\rho_1$, and an impedance represented by $Z_1$, wherein the drill pipe joint section structures have a phase velocity of $\upsilon_2$, a density of $\rho_2$, and an impedance represented by $Z_2$, and wherein $Z_1(\upsilon_1 \cdot \rho_1) \approx Z_2(\upsilon_2 \cdot \rho_2)$.

11. A method for building a drillstring, the method comprising:

arranging multiple drill pipe sections and multiple drill pipe joint section structures in a non-periodic sequence of lengths in the drillstring; and coupling drill pipe sections together through one or more of the drill pipe joint section structures, wherein the drill pipe joint section structures and the drill pipe sections are acoustically impedance matched across a selected band of frequencies.

12. The method of claim 11, wherein the drill pipe sections and the drill pipe joint section structures include lengths of at least a length $L_A$, a length $L_B$, or a length $L_C$, and wherein the length $L_A \neq$ the length $L_B \neq$ the length $L_C$.

13. The method of claim 11, wherein the drill pipe sections include several pipes which have different lengths.

14. The method of claim 11, wherein coupling the adjacent drill pipe sections together through one or more of the drill pipe joint section structures comprises coupling drill pipe sections and drill pipe joint section structures having substantially similar material properties.

15. The method of claim 11, wherein coupling the adjacent drill pipe sections together through one or more of the drill pipe joint section structures comprises coupling drill pipe sections and drill pipe joint section structures comprising the same material.

16. A method for acoustic communication over a drillstring, the method comprising:

arranging multiple drill pipe sections and multiple drill pipe joint section structures in a non-periodic sequence of lengths in the drillstring; and transmitting a signal from a downhole environment over the drillstring using an acoustic telemetry method, wherein each one of the drill pipe joint section structures is configured to couple drill pipe sections together, wherein the drill pipe sections and the drill pipe joint section structures are acoustically impedance matched across a selected band of frequencies.

17. The method of claim 16, further comprising:

receiving the signal on a surface of a geological formation; and demodulating the signal.

18. A drilling system comprising:

a drilling rig located on a surface of a geological formation; and a drillstring supported by the drilling rig and configured to drill through the geological formation, the drillstring comprising a non-periodic sequence of lengths of multiple drill pipe sections and multiple drill pipe joint section structures, with drill pipe sections joined by one or more of the drill pipe joint section structures, wherein the drill pipe sections and the drill pipe joint section structures are acoustically impedance matched across a selected band of frequencies.

19. The drilling system of claim 18, wherein the drill pipe sections and the drill pipe joint section structures have substantially similar material properties.

20. The drilling system of claim 18, wherein the drill pipe sections and the drill pipe joint section structures comprise the same material.

21. The drilling system of claim 18, wherein the drillstring further comprises a downhole tool configured to transmit acoustic telemetry over the drillstring during logging while drilling (LWD) and/or measuring while drilling (MWD) operations.

* * * * *